US010823388B2

(12) United States Patent
Tavernese et al.

(10) Patent No.: US 10,823,388 B2
(45) Date of Patent: Nov. 3, 2020

(54) PRESSURE EQUALIZED LIGHTING SUBASSEMBLY

(71) Applicant: Current Lighting Solutions, LLC, East Cleveland, OH (US)

(72) Inventors: Luigi Tavernese, Lachine (CA); Brian Morgan Spahnie, East Cleveland, OH (US); Robert Spivock, Lachine (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/295,752

(22) Filed: Mar. 7, 2019

(65) Prior Publication Data

US 2020/0284422 A1 Sep. 10, 2020

(51) Int. Cl.
*F21V 29/83* (2015.01)
*F21S 4/10* (2016.01)
(Continued)

(52) U.S. Cl.
CPC ..... *F21V 29/83* (2015.01); *F21S 4/10* (2016.01); *F21V 19/0025* (2013.01); *F21Y 2115/10* (2016.08)

(58) Field of Classification Search
CPC ..... F21V 29/83; F21V 19/0025; F21S 4/10; F21Y 2115/10
See application file for complete search history.

(56) References Cited

U.S. PATENT DOCUMENTS 5,434,748 A 7/1995 Fukui et al.
7,506,995 B2 3/2009 Thomas et al.
(Continued)

FOREIGN PATENT DOCUMENTS

KR 101733465 B1 5/2017
KR 20180003957 A 1/2018
(Continued)

OTHER PUBLICATIONS

Product: Use Microporous Vents for Reliable LED Luminaire Designs.
(Continued)

*Primary Examiner* — Donald L Raleigh
(74) *Attorney, Agent, or Firm* — Buckley, Maschoff & Telwalkar LLC

(57) ABSTRACT

Provided is a lighting subassembly that includes a printed circuit board having one or more lighting elements thereon and a single through-hole at a center region thereof for air flow, a lens to cover the one or more lighting elements, and an overmold body covering the lighting assembly. The overmold body secures the lens in place and covers a back surface of the printed circuit board opposite the one or more lighting elements and includes a plurality of through-holes corresponding to the through-hole of the printed circuit board. A vent is also included in the lighting subassembly and is disposed adjacent to the through-hole of the printed circuit board in between the overmold body and the printed circuit board, configured to only allow air to flow there-through such that the through-holes and the vent together create a venting system to allow airflow through the lighting subassembly.

20 Claims, 5 Drawing Sheets

(51) Int. Cl.
*F21V 19/00* (2006.01)
*F21Y 115/10* (2016.01)

(56) References Cited

U.S. PATENT DOCUMENTS

| | | | | |
|---|---|---|---|---|
| 7,909,482 | B2 * | 3/2011 | Veenstra | B29C 45/14639 362/249.05 |
| 7,931,386 | B2 * | 4/2011 | Nall | F21V 21/002 362/249.02 |
| 8,398,262 | B2 | 3/2013 | Sloan et al. | |
| 8,827,508 | B2 * | 9/2014 | Sagal | B29C 45/14 362/373 |
| 8,860,209 | B1 * | 10/2014 | Isaacson | F21V 21/14 257/712 |
| 9,303,861 | B2 * | 4/2016 | Li | F21V 31/04 |
| 9,995,454 | B2 * | 6/2018 | Marcoux | F21V 5/04 |
| 10,128,426 | B1 * | 11/2018 | Zykin | H01L 33/647 |
| 2007/0121326 | A1 * | 5/2007 | Nall | F21V 29/004 362/294 |
| 2008/0232105 | A1 * | 9/2008 | Saha | B29C 45/14065 362/267 |
| 2009/0154182 | A1 * | 6/2009 | Veenstra | B60Q 1/2696 362/487 |
| 2009/0196016 | A1 * | 8/2009 | Massara | H04R 1/028 362/86 |
| 2011/0007509 | A1 * | 1/2011 | Hayes | B29C 33/38 362/249.14 |
| 2012/0153865 | A1 * | 6/2012 | Rolfes | F21V 23/003 315/294 |
| 2013/0039063 | A1 * | 2/2013 | Quaal | F21V 31/04 362/235 |
| 2013/0208469 | A1 * | 8/2013 | Progl | F21V 29/506 362/235 |
| 2017/0084803 | A1 | 3/2017 | Iwaki | |
| 2017/0167701 | A1 | 6/2017 | Erdener et al. | |
| 2019/0145608 | A1 * | 5/2019 | Gorman | F21K 9/20 362/311.02 |

FOREIGN PATENT DOCUMENTS

| | | | |
|---|---|---|---|
| WO | 2000013163 | A1 | 3/2000 |
| WO | 2013024943 | A1 | 2/2013 |
| WO | 2014142396 | A1 | 9/2014 |

OTHER PUBLICATIONS

Chen et. al.: "Use Microporous Vents for Reliable LED Luminaire Designs" LEDs Magazine, Jun. 9, 2015.

International Search Report and Written Opinion dated May 22, 2020 which was issued in connection with PCT/US2020/016105 which was filed on Jan. 31, 2020.

* cited by examiner

PRESSURE EQUALIZED LIGHTING SUBASSEMBLY

TECHNICAL FIELD

The technical field relates generally to a lighting overmold assembly. In particularly, a pressure equalized overmold assembly for a lighting assembly (e.g., an LED lighting assembly).

BACKGROUND

In typical signage applications, a light string assembly 50, as shown in FIG. 1, includes lighting subassemblies 55 having strings of light emitting diodes (LEDs) 60, connected together via wires 65 and strung together to make the signage. The light string assembly 50 can be used outside exposed to the weather in damp or wet environments.

Overmolding of the subassemblies 55 can be compromised when submerged in water (e.g., rain water) such that the water is sucked in through the subsassembly 55 seams, and water can be wicked through the joining wires 65 due to the pressure difference between the inside of the subassembly 55 and the ambient environment. The differences are caused by the temperature difference between the relatively hot LEDs and the cold temperature outside of the subassemblies 55.

Pressure equalization of the lighting subassemblies 55 is desirable, thereby making the subassemblies 55 more robust to water submersion.

SUMMARY OF THE EMBODIMENTS

In one exemplary embodiment, a lighting subassembly is provided. The lighting subassembly includes a printed circuit board having one or more lighting elements thereon and a single through-hole or a plurality of through-holes on the printed circuit board thereof for air flow, a lens to cover the one or more lighting elements, and an overmold body that secures the lens in place, and covers a back surface of the printed circuit board opposite the one or more lighting elements, and includes a plurality of through-holes corresponding to the through-hole of the printed circuit board. A vent is also included in the subassembly, and is disposed adjacent to the through-hole of the printed circuit board in between the overmold body and the printed circuit board, configured to only allow air to flow therethrough such that the through-holes and the vent together create a venting system to allow airflow through the lighting subassembly.

In another exemplary embodiment, a lighting assembly employing the above-mentioned lighting subassembly is provided.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
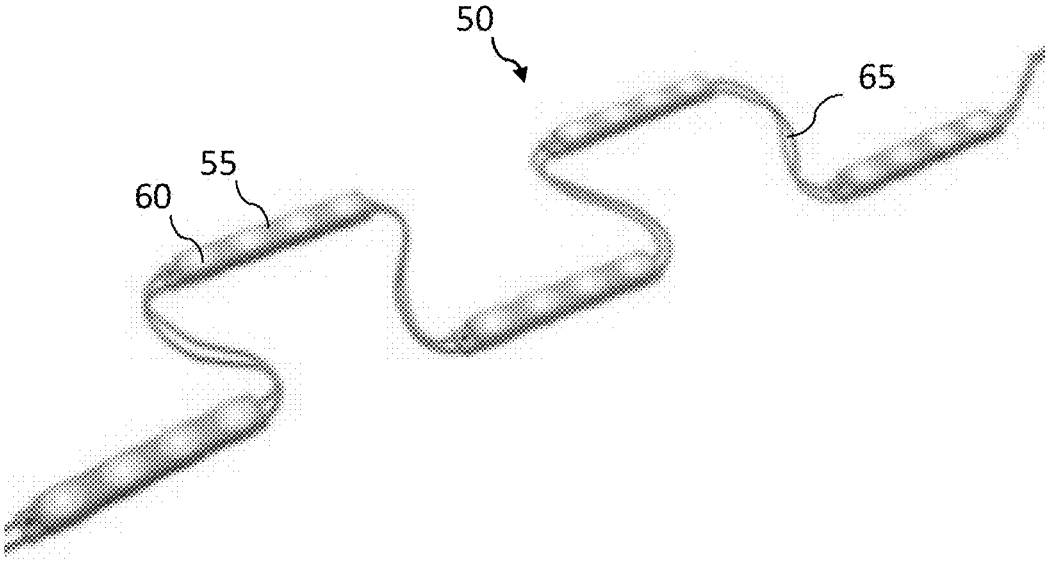
Prior Art FIG. 1
FIG. 1 is a light string assembly of a conventional lighting system.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Exemplary embodiments of the present invention provide light (LED) subassembly of a light string assembly, for example, that provides pressure equalization within the subassembly to protect against water submersion and allow air to flow therethrough. The present invention is not limited to being employed within light string assembly type lighting and can be employed in other suitable lighting assemblies. Details of the light assembly will be discussed with reference to FIGS. 2 through 6.

Figure 2:
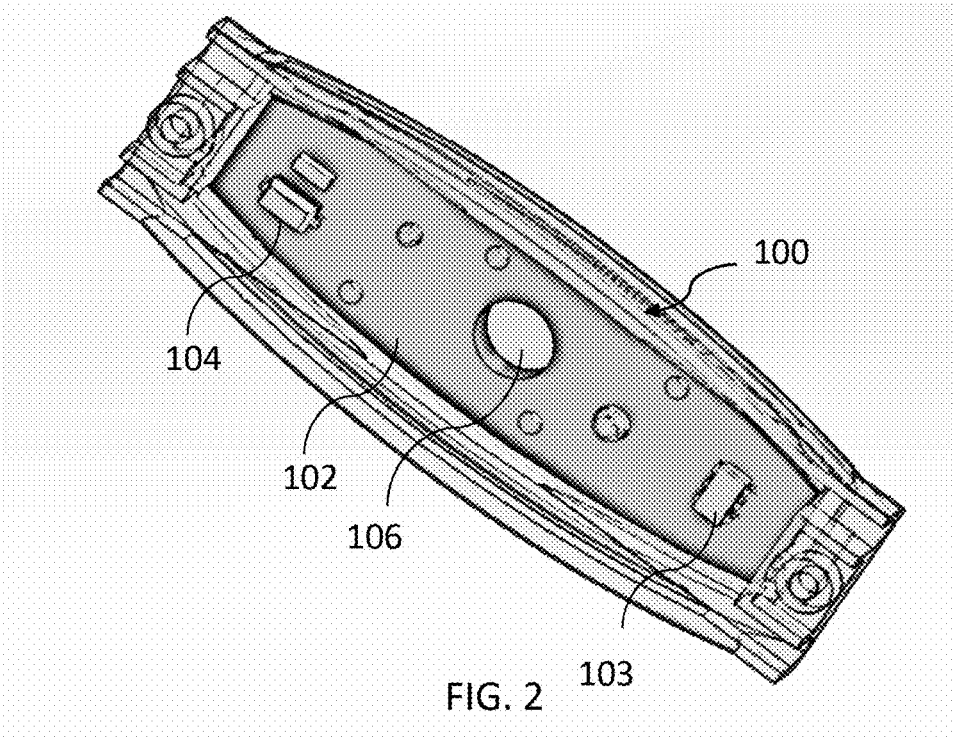
FIG. 2 is perspective view of a printed circuit board (PCB) subassembly of a light string assembly, for example, according to one or more exemplary embodiments of the present invention.

As shown in FIG. 2, a lighting subassembly 100 is provided, and includes a PCB 102 housing lighting components 103, 104 on a back surface for operation of LEDs 110 on a front surface thereof. The lighting subassembly 100 further includes a through-hole 104 in a center region thereof to allow air to flow therethrough while preventing submersion in water.

Figure 3:
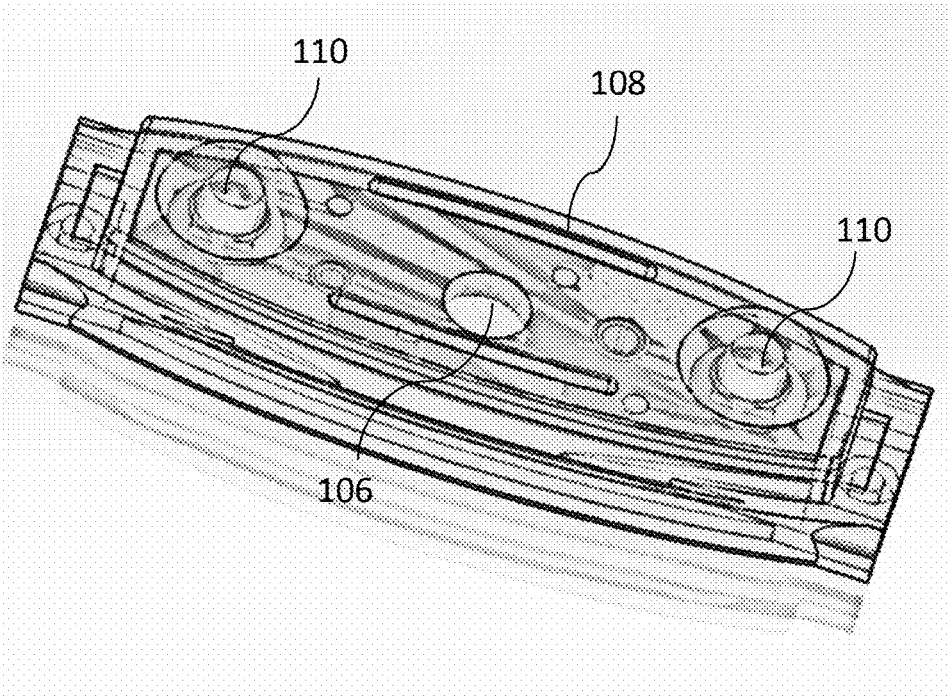
FIG. 3 is a lens of a light string assembly according to one or more exemplary embodiments of the present invention.

As shown in FIG. 3, the lighting subassembly 100 further includes a lens 108 on a front surface thereof covering the LEDs 110. The lens 108 covers the top surface of the lighting subassembly 100 including LEDs 110 disposed thereon and the through-hole 106.

The LEDs 110 can be semiconductor, organic or polymeric LEDs or similar devices. The LEDs 110 are configured to receive output power from a lighting driver (not shown) and to emit light as controlled.

Figure 4:
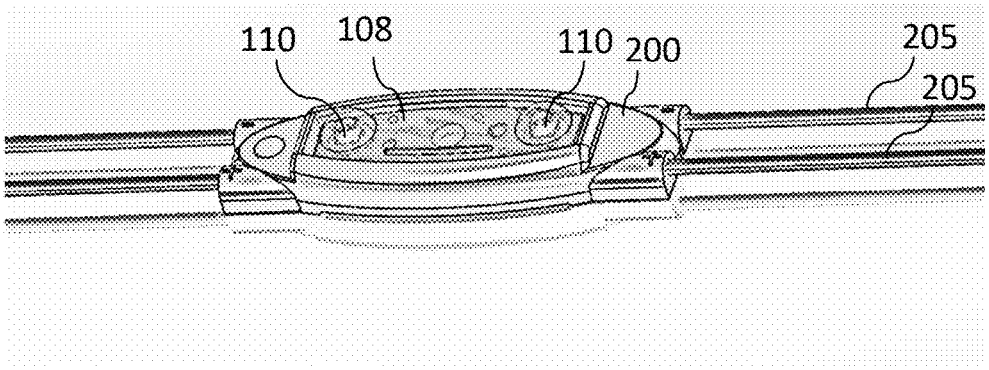
FIG. 4 is a perspective front view of lighting subassembly of the light string assembly according to one or more exemplary embodiments of the present invention.

In FIG. 4, the lighting subassembly 100 and lens 108 are overmolded with an overmold body 200 securing the lens 108 in place. The overmold body 200 is formed of a hard plastic material or the like for forming an exterior of the PCB subassembly 100. The overmold body 200 has a top surface and a back surface which respectively covers the top surface and bottom surface of the PCB assembly 100. The overmold body 200 includes positive and negative inputs for receiving wires 205 therein for supplying power to the LEDs 110 on the PCB subassembly 100.

Details regarding a venting process for the lighting subassembly 100 will now be discussed with reference to FIGS. 5 and 6.

Figure 5:
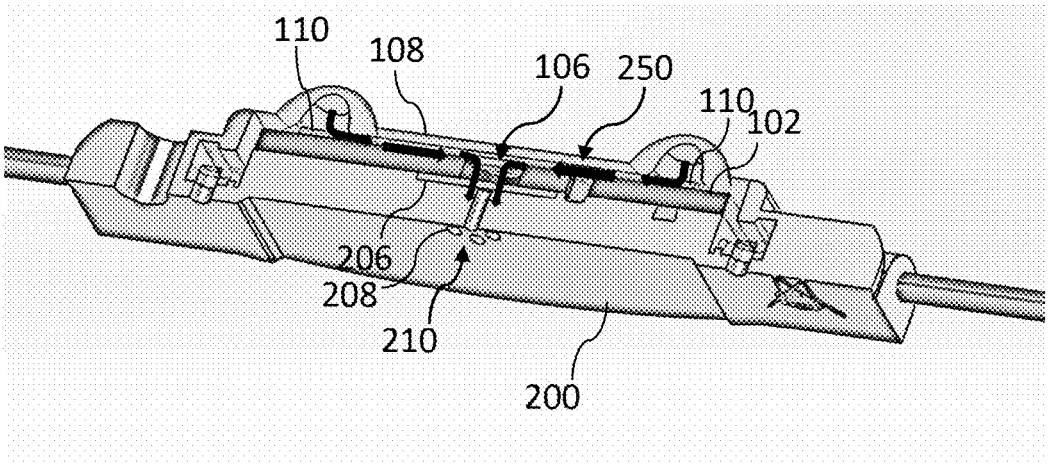
FIG. 5 is a perspective back view of the lighting subassembly according to one or more exemplary embodiments of the present invention.

As shown in FIG. 5, a vent 206 is provided adjacent to the through-hole 106 of the PCB 102, between the PCB 102 and the overmold body 200. The vent 206 is formed of a thin film membrane which allows air to flow therethrough while blocking water and other particles and potentially damaging the PCB 102 and other components of the PCB subassembly 100. The vent 206 can be formed of expanded polytetrafluoroethylene (ePTFE) or other fluoropolymers or microporous material or structure that prevents water from flowing through the vent 206, but allows air to flow therethrough.

Figure 6:
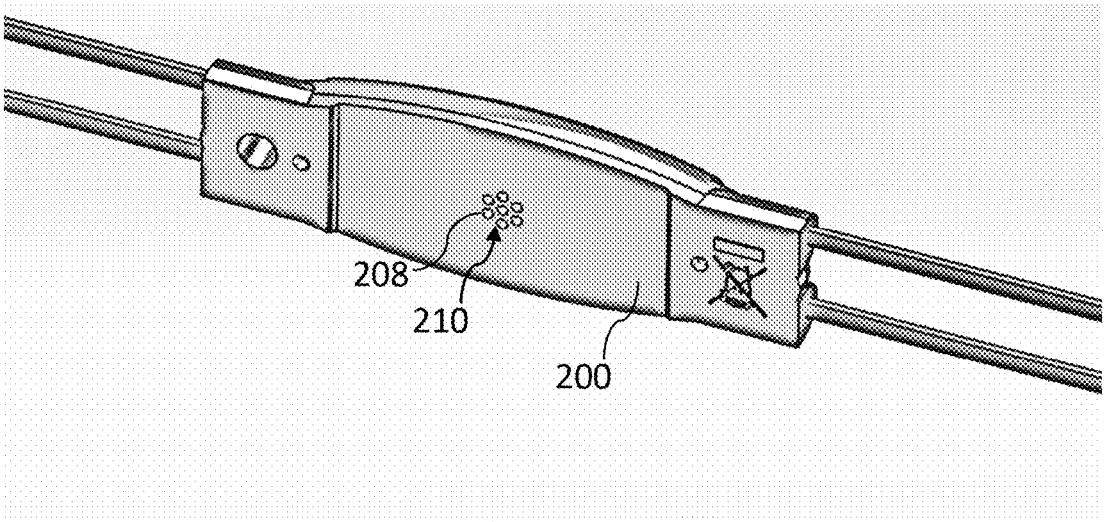
FIG. 6 is a perspective view of a vent of the lighting subassembly of FIGS. 2 through 5 according to one or more exemplary embodiments of the present invention.

Further, as shown in FIGS. 5 and 6, the back of the lighting subassembly 100 is covered by the overmold body 200. Within the overmold body 200 a plurality of through-holes 208 corresponding to the through-hole 106 of the PCB 102 extend vertically through the overmold body 200 to an outside surface of the thereof opposite the side adjacent to the PCB 102. Although a plurality of through-holes 208 are shown the present invention is not limited to any particular size or number of through-holes 208 and can include only a single through-hole to correspond to the through-hole 106 of the PCB 102.

The plurality of through-holes 208 form a hole pattern 210 aligned with the through-hole 106. The through-holes 106 and 208 along with the vent 206 operate together as a venting system to expel air from the PCB subassembly 100. The overmold body 200 creates a clearance at the location of the vent 206 and secures the vent 206 in a predetermined position while also providing the clearance for airflow, as shown by arrows 250.

As shown, the air flows from between the lens 108 over the LEDS 110 and a top surface of the PCB 102 and then through the through-hole 106 of the PCB 102, the vent 206 and then out through the hole pattern 210 including the through-holes 208 to the ambient environment.

Some of the advantages of embodiments of the present invention, include that the PCB subsassembly provides pressure equalization within the subassembly to protect against water submersion while also allowing air to flow therethrough.

This written description uses examples to disclose the invention, including the best mode, and also to enable any person skilled in the art to practice the invention, including making and using any devices or systems and performing any incorporated methods.

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A lighting subassembly comprising:

a printed circuit board having one or more lighting elements thereon and a single through-hole at a center region thereof for air flow;

a lens configured to cover the one or more lighting elements and the through-hole;

an overmold body configured to secure the lens in place, and to cover a back surface of the printed circuit board opposite the one or more lighting elements, and including a plurality of through holes corresponding to the through-hole of the printed circuit board; and a vent disposed adjacent to the through-hole of the printed circuit board in between the overmold body and the printed circuit board, configured to only allow air to flow therethrough, wherein the through-holes and the vent together create a venting system to allow airflow through the lighting subassembly.

2. The lighting subassembly of claim 1, wherein the printed circuit board further comprising lighting components on the back surface, spaced a predetermined distance apart from the through-hole therein, and are configured to perform operation of the one or more lighting elements.

3. The lighting subassembly of claim 2, wherein the overmold body is configured to overmold the printed circuit board not covered by the lens and a part of the lens itself, and to hold the vent in place.

4. The lighting subassembly of claim 3, wherein the plurality of through-holes forming a hole pattern on an outside surface of the overmold body, the hole pattern being aligned with the through-hole of the printed circuit board to allow air to be expelled therefrom.

5. The lighting subassembly of claim 4, wherein the plurality of through-holes forming the hole pattern, each extend vertically through the overmold body to the outside surface of thereof opposite a side thereof adjacent to the printed circuit board.

6. The lighting subassembly of claim 5, wherein the overmold body creates a clearance at a location of the vent and secures the vent in a predetermined position while providing the clearance for air flow.

7. The lighting subassembly of claim 6, wherein air flows from an area between the lens over the one or more lighting elements and a top surface of the printed circuit board, and then through the through-hole of the printed circuit board and through the plurality of through-holes forming the hole pattern at the outside surface of the overmold body to the ambient environment.

8. The lighting subassembly of claim 1, wherein the through-hole of the printed circuit board is larger in diameter than the plurality of through-holes of the overmold body.

9. A lighting assembly comprising:

a lighting subassembly comprising:

a printed circuit board having one or more lighting elements thereon and a single through-hole at a center region thereof for air flow;

a lens configured to cover the one or more lighting elements and the through-hole;

an overmold body configured to: secure the lens in place, and to cover a back surface of the printed circuit board opposite the one or more lighting elements, and including a plurality of through-holes corresponding to the through-hole of the printed circuit board; and a vent disposed adjacent to the through-hole of the printed circuit board in between the overmold body and the printed circuit board, configured to only allow air to flow therethrough, wherein the through-holes, and the vent together create a venting system to allow airflow through the lighting subassembly.

10. The lighting assembly of claim 9, wherein the printed circuit board further comprising lighting components on the back surface, spaced a predetermined distance apart from the through-hole therein, and are configured to perform operation of the one or more lighting elements.

11. The lighting assembly of claim 10, wherein the overmold body is configured to overmold the printed circuit board not covered by the lens and a part of the lens itself, and to hold the vent in place.

12. The lighting assembly of claim 11, wherein the plurality of through-holes forming a hole pattern on the outside surface of the overmold body, the hole pattern being aligned with the through-hole of the printed circuit board to allow air to be expelled therefrom.

13. The lighting assembly of claim 12, wherein each through-hole of the overmold body extends vertically therethrough to an outside surface thereof opposite a side thereof adjacent to the printed circuit board.

14. The lighting assembly of claim 13, wherein the overmold body creates a clearance at a location of the vent and secures the vent in a predetermined position while providing the clearance for air flow.

15. The lighting assembly of claim 14, wherein air flows from an area between the lens over the one or more lighting elements and a top surface of the printed circuit board, and then through the through-hole of the printed circuit board and through the plurality of through-holes forming the hole pattern at the outside surface of the overmold body to the ambient environment.

16. A lighting subassembly comprising:

a printed circuit board having one or more lighting elements thereon and at least one through-hole at a region thereof for air flow;

a lens configured to cover the one or more lighting elements;

a body configured to secure the lens in place and to cover a back surface of the printed circuit board opposite the one or more lighting elements; and a vent disposed adjacent to the through-hole of the printed circuit board in between the body and the printed circuit board and configured to allow air to flow and prevent water from flowing therethrough, the vent comprised of a microporous material or structure that prevents water from flowing but allows air to flow, wherein the through-hole on the printed circuit board and the vent together create a venting system to allow airflow through the lighting subassembly.

17. The lighting subassembly of claim 16, wherein air flows from an area between the lens over the one or more lighting elements and a top surface of the printed circuit board, and then through the through-hole of the printed circuit board and through the vent, for flow to the ambient environment.

18. The lighting subassembly of claim 16, wherein the body is configured to be overmolded over the printed circuit board to hold the vent in place, the body including a plurality of through holes corresponding to the at least one through-hole of the printed circuit board.

19. The lighting subassembly of claim 16, wherein the microporous material or structure comprises expanded polytetrafluoroethylene.

20. The lighting subassembly of claim 16, wherein the at least one through-hole is a single through-hole at a center region of the printed circuit board.

* * * * *